US011274358B2

(12) United States Patent
Guo et al.

(10) Patent No.: US 11,274,358 B2
(45) Date of Patent: Mar. 15, 2022

(54) ALUMINUM ALLOY AND PREPARATION METHOD THEREOF

(71) Applicant: BYD COMPANY LIMITED, Shenzhen (CN)

(72) Inventors: Qiang Guo, Shenzhen (CN); Yongliang Xie, Shenzhen (CN); Mengjue Liao, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 127 days.

(21) Appl. No.: 16/626,477

(22) PCT Filed: Apr. 25, 2018

(86) PCT No.: PCT/CN2018/084487
§ 371 (c)(1),
(2) Date: Dec. 24, 2019

(87) PCT Pub. No.: WO2019/001121
PCT Pub. Date: Jan. 3, 2019

(65) Prior Publication Data

US 2020/0115777 A1 Apr. 16, 2020

(30) Foreign Application Priority Data

Jun. 29, 2017 (CN) ..... 201710530305.7

(51) Int. Cl.

| | |
|---|---|
| ***C22C 21/02*** | (2006.01) |
| ***B22D 21/00*** | (2006.01) |
| ***C22C 1/02*** | (2006.01) |
| ***C22C 1/06*** | (2006.01) |

(52) U.S. Cl.
CPC ..... *C22C 21/02* (2013.01); *B22D 21/007* (2013.01); *C22C 1/026* (2013.01); *C22C 1/06* (2013.01)

(58) Field of Classification Search
CPC ..... C22C 21/02; C22C 21/04; C22F 1/043
See application file for complete search history.

(56) References Cited

U.S. PATENT DOCUMENTS

2011/0268604 A1 11/2011 Cai
2012/0000578 A1* 1/2012 Wang ..... C22F 1/043 148/549

FOREIGN PATENT DOCUMENTS

| | | | |
|---|---|---|---|
| CN | 1809647 | A | 7/2006 |
| CN | 101805855 | A | 8/2010 |
| CN | 102312135 | A | 1/2012 |
| CN | 103526085 | A | 1/2014 |
| CN | 103924132 | A | 7/2014 |
| CN | 105296818 | A | 2/2016 |
| CN | 105441737 | A | 3/2016 |
| CN | 105463269 | A | 4/2016 |
| CN | 106636791 | A | 5/2017 |
| DE | 202006006518 | U1 | 9/2006 |
| GB | 595214 | A | 11/1947 |
| KR | 20000041707 | A | 7/2000 |

OTHER PUBLICATIONS

The World Intellectual Property Organization (WIPO) International Search Report for PCT/CN2018/084487 dated Jul. 11, 2018 6 Pages.
Zhutang Wang et al, "Aluminum alloy and the Processing Manual of Aluminum alloy", Central South University Publication, Jun. 1989, p. 173-174 ISBN7-81061-298-0.
Compile Group of The Processing Manual of Light Metal, "The Processing Manual of Light Metal" Published by metallurgical Industry Press, Dec. 1979, p. 12-13, Uniform book No. 15060-5462.
Weicheng Sun et al, "Behavior of Rare Earths in Aluminum alloy", Pulished by Weapon Industry Press, Mar. 1992, p. 240-241, ISBN7-80038-389-X.

* cited by examiner

*Primary Examiner* — Jessee R Roe
(74) *Attorney, Agent, or Firm* — Anova Law Group, PLLC

(57) ABSTRACT

An aluminum alloy and a preparation method thereof are provided. The aluminum alloy of the present disclosure includes, in percentage by weight, 8-10% of silicon, 0.2-0.4% of magnesium, 0-0.01% of manganese, 0-0.01% of titanium, 0.1-0.3% of iron, 0.02-0.06% of boron, 0.15-0.3% of cerium, and 88.92-91.53% of aluminum.

14 Claims, No Drawings

ALUMINUM ALLOY AND PREPARATION METHOD THEREOF

CROSS-REFERENCE TO RELATED APPLICATIONS

This application is a national phase entry under 35 U.S.C. § 371 of International Application No. PCT/CN2018/084487, filed on Apr. 25, 2018, which claims priority to and benefits of Chinese Patent Application No. 201710530305.7, filed on Jun. 29, 2017. The entire content of the above-referenced applications is incorporated herein by reference in its entirety.

FIELD

The present disclosure relates to an aluminum alloy and a preparation method thereof.

BACKGROUND

An aluminum alloy has the characteristics of light weight, good toughness, corrosion resistance, unique metallic luster, etc. It is used by more and more electronic appliances, communication equipment, lighting devices, automobiles and other components, such as shells of smart phones, laptops and tablets, radiators and lampshades of LED lamps, radiators, cabinets and filters of 3G and 4G wireless communication base stations, heating plates of rice cookers, induction cookers and water heaters, and controller cases and drive motor shells of new energy automobiles. In order to meet the needs of thin wall, lightweight, rapid heat dissipation and casting production of components, the casting fluidity, thermal conductivity and mechanical properties of the aluminum alloy are increasingly demanding. At present, the most commonly used cast aluminum alloys are Al—Si cast aluminum alloys, typical grades including ZL101, A356, A380, ADC10, ADC12, etc.

The Al—Si cast aluminum alloys usually contain 6.5% and above of Si, and thus have good casting fluidity and meet the casting process requirements. However, the Al—Si cast aluminum alloys have poor thermal conductivity, and a thermal conductivity coefficient is usually lower than 140 W/(m·K). The thermal conductivity coefficient of the A356 cast aluminum alloy is only about 120 W/(m·K), while the thermal conductivity coefficient of the ADC12 cast aluminum alloy is only about 96 W/(m·K), which makes it difficult for the Al—Si cast aluminum alloys to meet the functional requirements of rapid heat dissipation of components. Therefore, there is a need for an aluminum alloy that has both good casting and mechanical properties and high thermal conductivity to meet market demands.

SUMMARY

The present disclosure aims to solve at least one of the technical problems in the related art to some extent. Accordingly, it is an object of the present disclosure to provide an aluminum alloy which not only has good overall mechanical properties but also has high thermal conductivity.

According to a first aspect of the present disclosure, an aluminum alloy is provided, which includes, in percentage by weight, the following elements based on the total amount of the aluminum alloy:

| | |
|---|---|
| Si | 8-10%, |
| Mg | 0.2-0.4%, |
| Mn | 0-0.01%, |
| Ti | 0-0.01%, |
| Fe | 0.1-0.3%, |
| B | 0.02-0.06%, |
| Ce | 0.15-0.3%, |
| Al | 88.92-91.53%. |

According to a second aspect of the present disclosure, an aluminum alloy is provided, which includes, in percentage by weight, the following elements based on the total amount of the aluminum alloy:

| | |
|---|---|
| Si | 8-10%, |
| Mg | 0.2-0.4%, |
| Mn | 0-0.01%, |
| Ti | 0-0.01%, |
| Fe | 0.1-0.3%, |
| B | 0.02-0.06%, |
| Ce | 0.15-0.3%, |

and the balance of aluminum.

According to a third aspect of the present disclosure, a method for preparing an aluminum alloy is provided, which includes: sequentially smelting and casting an aluminum alloy raw material, where the aluminum alloy raw material has such components that an obtained aluminum alloy is the aluminum alloy provided by the present disclosure.

The aluminum alloy provided by the present disclosure exhibits good comprehensive mechanical properties, not only has high strength and hardness, but also has high elongation and good casting properties. More importantly, the aluminum alloy provided by the present disclosure has good thermal conductivity of generally more than 150 W/(m·K), more than 160 W/(m·K) under some conditions or even more than 170 W/(m·K).

The aluminum alloy provided by the present disclosure is suitable as a structural material highly required in thermal conductivity, including but not limited to component materials of electronic appliances, communication equipment, lighting devices, and automobiles.

Other features and advantages of the present disclosure will be described in detail in the following detailed description.

DETAILED DESCRIPTION

An aluminum alloy according to some embodiments of the present disclosure includes, in percentage by weight, the following elements based on the total amount of the aluminum alloy:

| | |
|---|---|
| Si | 8-10%, |
| Mg | 0.2-0.4%, |
| Mn | 0-0.01% |
| Ti | 0-0.01% |
| Fe | 0.1-0.3%, |
| B | 0.02-0.06%, |
| Ce | 0.15-0.3%, |
| Al | 88.92-91.53%. |

The aluminum alloy of the present disclosure includes silicon (Si). The main function of silicon is to improve the fluidity of the aluminum alloy. In addition, silicon grains have good chemical stability and high hardness. With the increase of silicon in the aluminum alloy, the tensile strength and hardness of the alloy can be improved. The aluminum alloy has higher corrosion resistance and wear resistance than pure aluminum. However, when the content of silicon in the aluminum alloy is too high, the thermal conductivity of the aluminum alloy is adversely affected. An aluminum alloy according to some embodiments of the present disclosure includes, in percentage by weight, 8-10% of silicon based on the total amount of the aluminum alloy. An aluminum alloy according to some other embodiments of the present disclosure includes, in percentage by weight, 8.5-9.5% of silicon based on the total amount of the aluminum alloy. Thus, the synergistic action of silicon and other elements in the aluminum alloy allows the aluminum alloy provided by the present disclosure to have both good mechanical properties and thermal conductivity.

The aluminum alloy of the present disclosure includes magnesium (Mg). As a main strengthening element in an Al—Si alloy, magnesium may significantly increase the strength of the aluminum alloy. An aluminum alloy according to some embodiments of the present disclosure includes, in percentage by weight, 0.2-0.4% of magnesium based on the total amount of the aluminum alloy. An aluminum alloy according to some other embodiments of the present disclosure includes, in percentage by weight, 0.25-0.35% of magnesium based on the total amount of the aluminum alloy.

The aluminum alloy of the present disclosure may also include manganese (Mn). In the aluminum alloy, manganese may reduce the harmful effects of iron, a lamellar or acicular structure formed from iron in the aluminum alloy becomes a fine crystal structure, and grains are refined, which is beneficial to improving the mechanical properties of the aluminum alloy. However, manganese in the aluminum alloy will significantly reduce the thermal conductivity coefficient. An aluminum alloy according to some embodiments of the present disclosure includes, in percentage by weight, 0-0.01% of manganese based on the total amount of the aluminum alloy. Thus, the synergistic action of manganese and other elements in the aluminum alloy allows the aluminum alloy provided by the present disclosure to have both good mechanical properties and high thermal conductivity coefficient.

The introduction of a small amount of titanium (Ti) in the aluminum alloy may play a role in improving the mechanical properties of the alloy, but titanium reduces the thermal conductivity coefficient of the alloy. An aluminum alloy according to some embodiments of the present disclosure includes, in percentage by weight, 0-0.01% of titanium based on the total amount of the aluminum alloy. Thus, the synergistic action of titanium and other elements in the aluminum alloy allows the aluminum alloy provided by the present disclosure to have both good mechanical properties and high thermal conductivity coefficient.

The aluminum alloy of the present disclosure includes iron (Fe). Iron may reduce mold sticking during die casting of the aluminum alloy. However, when the content of iron in the aluminum alloy is too high, iron is present in the aluminum alloy in the form of a lamellar or acicular structure of $FeAl_3$, $Fe_2Al_7$ and Al—Si—Fe, thereby reducing the mechanical properties and fluidity of the aluminum alloy, and increasing the hot cracking of the aluminum alloy. In addition, high-content iron will reduce the thermal conductivity coefficient of the aluminum alloy. An aluminum alloy according to some embodiments of the present disclosure includes, in percentage by weight, 0.1-0.3% of iron based on the total amount of the aluminum alloy. An aluminum alloy according to some other embodiments of the present disclosure includes, in percentage by weight, 0.15-0.25% of iron based on the total amount of the aluminum alloy. Thus, not only mold sticking may be effectively reduced, but also the mechanical properties and fluidity of the aluminum alloy cannot be adversely affected. The synergistic action of iron and other elements in the aluminum alloy allows the aluminum alloy provided by the present disclosure to have both good mechanical properties and high thermal conductivity coefficient.

The aluminum alloy of the present disclosure includes boron (B). When the aluminum alloy is smelted, transition metal impurity elements (such as Cr or V) present in the aluminum alloy absorb free electrons in an aluminum alloy material to fill an incomplete electron layer thereof, resulting in decrease of the number of conductive electrons in the aluminum alloy and reduction of the thermal conductivity coefficient thereof. Boron may form a high-melting compound with the transition metal impurity elements in the aluminum alloy and form a precipitate, thereby reducing the adverse effect of the transition metal impurity element on the thermal conduction of the aluminum alloy. An aluminum alloy according to some embodiments of the present disclosure includes, in percentage by weight, 0.02-0.06% of boron based on the total amount of the aluminum alloy. An aluminum alloy according to some other embodiments of the present disclosure includes, in percentage by weight, 0.03-0.05% of boron based on the total amount of the aluminum alloy.

The aluminum alloy of the present disclosure includes cerium (Ce). The addition of cerium in the aluminum alloy improves the thermal conductivity of the aluminum alloy. Firstly, cerium may be used as a refining agent for the aluminum alloy, which has a strong degassing effect on an aluminum melt, and significantly reduces the pinhole ratio in the structure. Secondly, the addition of cerium may significantly reduce the amount of inclusions in the aluminum alloy structure and strengthen the compactness of an alloy as-cast structure. Then, cerium has a metamorphic effect on the as-cast structure, which may effectively control the solid solubility of an excess element. As the solid solubility is higher, the lattice distortion is greater, and the hindrance to the electron movement is stronger, so that the thermal conductivity coefficient is reduced. The inventors of the present disclosure have found that when the content of cerium in the aluminum alloy is 0.15-0.30%, the effect of improving the thermal conductivity of the aluminum alloy is optimal; when the content of cerium is less than 0.1%, the thermal conductivity of the aluminum alloy is not significantly affected and will not greatly change; and when the content of cerium exceeds 0.30%, the effect of improving the thermal conductivity of the aluminum alloy begins to decrease significantly. Therefore, an aluminum alloy according to some embodiments of the present disclosure includes, in percentage by weight, 0.15-0.3% of cerium based on the total amount of the aluminum alloy. An aluminum alloy according to some other embodiments of the present disclosure includes, in percentage by weight, 0.2-0.25% of cerium based on the total amount of the aluminum alloy.

The aluminum alloy according to an embodiment of the present disclosure allows a small amount of other metal elements such as one, two or more of Zr, V, Zn, Li, and Cr to be present. Based on the total amount of an aluminum alloy according to some embodiments of the present disclosure, in percentage by weight, the total amount of the other metal elements is generally not more than 0.1%. Based on the total amount of an aluminum alloy according to some other embodiments of the present disclosure, in percentage by weight, the total amount of the other metal elements is not more than 0.01%. The other metal elements are generally derived from impurities in the alloy raw material when the alloy is prepared.

An aluminum alloy according to some embodiments of the present disclosure also includes strontium (Sr). Strontium acts as a metamorphism on the aluminum alloy, removes impurities in the aluminum alloy, and refines alloy grains. In addition, the inventors of the present disclosure have found that when a specific range of strontium is present in the aluminum alloy of the present disclosure, the thermal conductivity may be further improved. An aluminum alloy according to some embodiments of the present disclosure includes, in percentage by weight, 0.03-0.05% of Sr based on the total amount of the aluminum alloy. Accordingly, the thermal conductivity of the aluminum alloy may be further improved.

The content of aluminum (Al) in an aluminum alloy according to some embodiments of the present disclosure may be adjusted according to the content of alloy elements.

An aluminum alloy according to some embodiments of the present disclosure includes, in percentage by weight, the following elements based on the total amount of the aluminum alloy:

| | |
|---|---|
| Si | 8-10%, |
| Mg | 0.2-0.4%, |
| Mn | 0-0.01%, |
| Ti | 0-0.01%, |
| Fe | 0.1-0.3%, |
| B | 0.02-0.06%, |
| Ce | 0.15-0.3%, |

and the balance of aluminum.

An aluminum alloy according to some embodiments of the present disclosure includes, in percentage by weight, the following elements based on the total amount of the aluminum alloy:

| | |
|---|---|
| Si | 8-10%, |
| Mg | 0.2-0.4%, |
| Mn | 0-0.01%, |
| Ti | 0-0.01%, |
| Fe | 0.1-0.3%, |
| B | 0.02-0.06%, |
| Ce | 0.15-0.3%, |
| Sr | 0.03-0.05%, |

and the balance of aluminum.

An aluminum alloy according to some embodiments of the present disclosure does not include copper (i.e., in an aluminum alloy according to some embodiments of the present disclosure, the content of Cu is 0 in percentage by weight), which may further enhance the corrosion resistance and plasticity of the aluminum alloy according to the present disclosure, reduce the hot cracking tendency and increase the thermal conductivity coefficient thereof.

The aluminum alloy of the present disclosure may be prepared by various conventional methods. Specifically, an aluminum alloy raw material may be sequentially smelted and cast, where the aluminum alloy raw material has such components that an obtained aluminum alloy is the aluminum alloy in the above embodiments of the present disclosure.

In the present disclosure, the aluminum alloy of the present disclosure may be prepared and cast by using a method including the following steps.

(1) Provide an aluminum alloy raw material

The raw material is provided in accordance with a predetermined aluminum alloy composition, and each element in the aluminum alloy may be provided in the form of pure metal or may be provided in the form of an intermediate alloy.

(2) Smelt the aluminum alloy raw material

The smelting method may be various conventional smelting methods in the art, as long as the aluminum alloy raw material is sufficiently melted, and smelting equipment may be conventional smelting equipment such as a vacuum arc smelting furnace, a vacuum induction smelting furnace or a vacuum resistance furnace.

(3) Refine

A refining agent is added to alloy liquid obtained in step (2), and refining is performed to remove non-metallic inclusions in the alloy liquid.

(4) Cast

The aluminum alloy liquid obtained in step (3) is cast and cooled to obtain an alloy ingot, and the alloy ingot is die-cast to obtain a die-cast body.

The aluminum alloy provided by the present disclosure not only has good overall mechanical properties, but also has a yield strength of more than 135 MPa, an elongation of more than 3%, generally 3-5%, and an excellent thermal conductivity of more than 150 W/(m·K), or 160-175 W/(m·K) under some conditions.

The aluminum alloy provided by the present disclosure is suitable as a structural material highly required in thermal conductivity, including but not limited to component materials of electronic appliances, communication equipment, lighting devices, and automobiles.

The present disclosure is described in detail below with reference to the embodiments, without however limiting the scope of the present disclosure.

All samples in the following embodiments and comparative examples were tested for tensile properties (yield strength, tensile strength and elongation) using a 1.5 mm-thick tensile standard in accordance with GBT 228.1-2010.

In addition, a thermal conductivity coefficient test was carried out at a temperature of 25° C. First, density and specific heat capacity were tested. Then, according to ASTM-E-1461-01, a thermal diffusivity coefficient test was carried out using a disk having a diameter of 12.7 mm and a thickness of 3 mm. The thermal conductivity coefficient is a product of the specific heat capacity, the density and the thermal diffusivity coefficient.

Embodiments 1-9 are used to illustrate the present disclosure.

Embodiment 1

A pure aluminum ingot (purity≥99.9 wt %), a pure silicon ingot (purity≥99.9 wt %), a pure magnesium ingot (purity≥99.9 wt %), an aluminum-iron intermediate alloy, an aluminum-boron intermediate alloy, an aluminum-titanium intermediate alloy and metal cerium were prepared according to the alloy composition in Table 1.

The pure aluminum ingot was added into a smelting furnace, smelted, and then maintained at a temperature of 720° C.-740° C. The pure silicon ingot was added, smelted, and then maintained at a temperature of 720° C.-740° C. The pure magnesium ingot was added, smelted, and then maintained at a temperature of 720° C.-740° C. The aluminum-iron intermediate alloy was added, smelted, and then maintained at a temperature of 720° C.-740° C. The aluminum-boron intermediate alloy, the aluminum-titanium intermediate alloy and the metal cerium were added, smelted, and then maintained at a temperature of 690° C.-710° C. Aluminum alloy liquid was stirred to make ingredients uniform, deslagged and then sampled for testing. According to the test results, the content of each element was adjusted until the required range was reached. A refining agent (hexachloroethane) was blown into the bottom of the aluminum alloy liquid by nitrogen gas for refining and degassing until the refining was finished.

The refined aluminum alloy was cast and cooled to obtain an alloy ingot, and the obtained alloy ingot was subjected to metal casting on a 160T cold die casting machine to obtain a die-cast body of the aluminum alloy of the present disclosure. The yield strength, tensile strength, elongation, and thermal conductivity coefficient of the prepared aluminum alloy were measured, the results being shown in Table 2.

Embodiments 2-9

A die-cast body of an aluminum alloy was prepared in the same manner as in Embodiment 1, except that an aluminum alloy raw material was prepared in accordance with the composition of Table 1.

The yield strength, tensile strength, elongation, and thermal conductivity coefficient of the prepared aluminum alloy were measured, the results being shown in Table 2.

Comparative Examples 1-7

A die-cast body of an aluminum alloy was prepared in the same manner as in Embodiment 1, except that an aluminum alloy raw material was prepared in accordance with the composition of Table 1.

The yield strength, tensile strength, elongation, and thermal conductivity coefficient of the prepared aluminum alloy were measured, the results being shown in Table 2.

TABLE 1

| Embodiment Number | Si | Mg | Mn | Ti | Fe | B | Ce | Sr | Cu |
|---|---|---|---|---|---|---|---|---|---|
| Embodiment 1 | 9.0 | 0.3 | 0.01 | 0.01 | 0.2 | 0.03 | 0.22 | / | / |
| Embodiment 2 | 9.5 | 0.35 | 0.01 | 0.01 | 0.25 | 0.04 | 0.2 | / | / |
| Embodiment 3 | 8.5 | 0.25 | 0.01 | 0.01 | 0.15 | 0.05 | 0.25 | / | / |
| Embodiment 4 | 9.0 | 0.3 | 0.01 | 0.01 | 0.2 | 0.03 | 0.15 | / | / |
| Embodiment 5 | 9.0 | 0.3 | 0.01 | 0.01 | 0.2 | 0.03 | 0.3 | / | / |
| Embodiment 6 | 9.0 | 0.3 | 0.01 | 0.01 | 0.2 | 0.02 | 0.22 | / | / |
| Embodiment 7 | 9.0 | 0.3 | 0.01 | 0.01 | 0.2 | 0.06 | 0.22 | / | / |
| Embodiment 8 | 8.5 | 0.25 | 0.01 | 0.01 | 0.3 | 0.05 | 0.25 | / | / |
| Embodiment 9 | 8.5 | 0.25 | 0.01 | 0.01 | 0.15 | 0.05 | 0.25 | 0.04 | / |
| Comparative Example 1 | 9.0 | 0.3 | 0.01 | 0.01 | 0.2 | 0.03 | 0.1 | / | / |
| Comparative Example 2 | 9.0 | 0.3 | 0.01 | 0.01 | 0.2 | 0.03 | 0.4 | / | / |
| Comparative Example 3 | 9.0 | 0.3 | 0.01 | 0.01 | 0.2 | / | 0.22 | / | / |
| Comparative Example 4 | 9.5 | 0.35 | 0.03 | 0.01 | 0.25 | 0.04 | 0.2 | / | / |
| Comparative Example 5 | 9.5 | 0.35 | 0.01 | 0.02 | 0.25 | 0.04 | 0.2 | / | / |
| Comparative Example 6 | 8.5 | 0.25 | 0.01 | 0.01 | 0.4 | 0.05 | 0.25 | / | / |
| Comparative Example 7 | 9.0 | 0.3 | 0.01 | 0.01 | 0.2 | 0.03 | 0.22 | / | 1.0 |

Note:

Each ratio in Table 1 is in percentage by weight, and the balance is aluminum and unavoidable impurities, where the total weight of the impurity elements is less than 0.1 wt %.

TABLE 2

| Embodiment Number | Yield Strength (MPa | Tensile Strength (MPa) | Elongation (%) | Thermal Conductivity Coefficient (W/(M · k)) |
|---|---|---|---|---|
| Embodiment 1 | 146 | 282 | 3.6 | 166 |
| Embodiment 2 | 156 | 290 | 3.2 | 161 |
| Embodiment 3 | 138 | 268 | 4.4 | 175 |
| Embodiment 4 | 140 | 272 | 3.8 | 160 |
| Embodiment 5 | 149 | 285 | 3.4 | 158 |
| Embodiment 6 | 143 | 276 | 4 | 162 |
| Embodiment 7 | 148 | 284 | 3.4 | 163 |
| Embodiment 8 | 137 | 269 | 4.3 | 159 |
| Embodiment 9 | 138 | 268 | 4.4 | 180 |
| Comparative Example 1 | 139 | 270 | 3.7 | 155 |
| Comparative Example 2 | 150 | 287 | 3.3 | 153 |
| Comparative Example 3 | 148 | 284 | 3.9 | 157 |
| Comparative Example 4 | 164 | 297 | 2.5 | 142 |
| Comparative Example 5 | 161 | 294 | 2.8 | 145 |
| Comparative Example 6 | 139 | 270 | 4.2 | 156 |
| Comparative Example 7 | 154 | 287 | 3.4 | 149 |

The results of Table 2 show that the aluminum alloy according to the present disclosure not only has good overall mechanical properties but also has high thermal conductivity.

By comparing Embodiment 1 with Comparative Example 1 and Comparative Example 2, it can be seen that when the content of cerium is too high or too low in the aluminum alloy, the thermal conductivity of the aluminum alloy is not good.

By comparing Embodiment 1 with Comparative Example 3, it can be seen that when there is no boron in the aluminum alloy, the thermal conductivity of the aluminum alloy is not good.

By comparing Embodiment 2 with Comparative Example 4, it can be seen that when the content of manganese is too high in the aluminum alloy, the thermal conductivity of the aluminum alloy is adversely affected.

By comparing Embodiment 2 with Comparative Example 5, it can be seen that when the content of titanium is too high in the aluminum alloy, the thermal conductivity of the aluminum alloy is adversely affected.

By comparing Embodiment 3 with Comparative Example 6, it can be seen that when the content of iron is too high in the aluminum alloy, the thermal conductivity of the aluminum alloy is adversely affected.

By comparing Embodiment 1 with Comparative Example 7, it can be seen that when there is copper in the aluminum alloy, the thermal conductivity of the aluminum alloy is adversely affected.

The preferred embodiments of the present disclosure have been described in detail above, but the present disclosure is not limited thereto. Various simple variations, including the combination of the technical features in any other suitable manner, may be made to the technical solutions of the present disclosure without creative efforts. Such simple variations and combinations shall also be considered as the content disclosed by the present disclosure and shall all fall within the protection scope of the present disclosure.

What is claimed is:

1. An aluminum alloy, comprising, in percentage by weight and based on the total amount of the aluminum alloy:

| | |
|---|---|
| Si | 8-10%, |
| Mg | 0.2-0.4%, |
| Mn | 0-0.01%, |
| Ti | 0-0.01%, |
| Fe | 0.1-0.3%, |
| B | 0.02-0.06%, and |
| Ce | 0.15-0.3%, wherein: |

a yield strength of the aluminum alloy is more than 135 MPa;

an elongation of the aluminum alloy is more than 3%; and a thermal conductivity of the aluminum alloy is more than 150 W/(m·k).

2. The aluminum alloy according to claim 1, further comprising, in percentage by weight and based on the total amount of the aluminum alloy:

| | |
|---|---|
| aluminum | 88.92-91.53%. |

3. The aluminum alloy according to claim 2, wherein the aluminum alloy comprises, in percentage by weight, 0.2-0.25% of Ce based on the total amount of the aluminum alloy.

4. The aluminum alloy according to claim 2, wherein the aluminum alloy comprises, in percentage by weight, 0.03-0.05% of B based on the total amount of the aluminum alloy.

5. The aluminum alloy according to claim 2, wherein the aluminum alloy comprises, in percentage by weight, 8.5-9.5% of Si based on the total amount of the aluminum alloy.

6. The aluminum alloy according to claim 2, wherein the aluminum alloy comprises, in percentage by weight, 0.25-0.35% of Mg based on the total amount of the aluminum alloy.

7. The aluminum alloy according to claim 2, wherein the aluminum alloy comprises, in percentage by weight, 0.15-0.25% of Fe based on the total amount of the aluminum alloy.

8. The aluminum alloy according to claim 2, wherein the aluminum alloy also comprises, in percentage by weight, 0.03-0.05% of Sr based on the total amount of the aluminum alloy.

9. The aluminum alloy according to claim 2, wherein the aluminum alloy comprises, in percentage by weight, not more than 0.1% of impurities based on the total amount of the aluminum alloy.

10. A method for preparing an aluminum alloy, comprising:

providing an aluminum alloy raw material including 8-10% of Si, 0.2-0.4% of Mg, 0-0.01% of Mn, 0-0.01% of Ti, 0.1-0.3% of Fe, 0.02-0.06% of B, 0.15-0.3% of Ce, and 88.92-91.53% of Al;

smelting the aluminum alloy raw material in a furnace into an alloy liquid;

adding a refining agent to the alloy liquid; and casting the alloy liquid to obtain a die-cast body of the aluminum alloy, wherein:

a yield strength of the aluminum alloy is more than 135 MPa;

an elongation of the aluminum alloy is more than 3%; and a thermal conductivity of the aluminum alloy is more than 150 W/(m·k).

11. The method according to claim 10, wherein the aluminum alloy raw materials comprises, in percentage by weight, 0.2-0.25% of Ce.

12. The method according to claim 10, wherein the aluminum alloy raw materials comprises, in percentage by weight, 0.03-0.05% of B.

13. The method according to claim 10, wherein the aluminum alloy raw material comprises, in percentage by weight, 8.5-9.5% of Si.

14. The method according to claim 10, wherein the aluminum alloy raw materials comprises, in percentage by weight, 0.25-0.35% of Mg.

* * * * *